US006021567A

United States Patent [19]

Saitoh

[11] Patent Number: 6,021,567

[45] Date of Patent: Feb. 8, 2000

[54] METHOD FOR PRODUCING AN INSULATION DISPLACEMENT TERMINAL AND THE SAME

[75] Inventor: Yasushi Saitoh, Nagoya, Japan

[73] Assignees: Sumitomo Wiring Systems, Ltd.; Sumitomo Electric Industries, Ltd.; Harness System Technologies, all of, Japan

[21] Appl. No.: 08/974,483

[22] Filed: Nov. 19, 1997

[30] Foreign Application Priority Data

Nov. 22, 1996 [JP] Japan ..... 8-311538

[51] Int. Cl.[7] ..... H01R 43/04

[52] U.S. Cl. ..... 29/866; 29/865; 29/863; 29/861

[58] Field of Search ..... 29/866, 865, 863, 29/861

[56] References Cited

U.S. PATENT DOCUMENTS

| | | | |
|---|---|---|---|
| 4,310,212 | 1/1982 | Aujla et al. | 339/97 R |
| 4,943,248 | 7/1990 | Colleran et al. | 439/850 |
| 5,018,269 | 5/1991 | Ishida et al. | 29/861 |
| 5,078,617 | 1/1992 | Gutierrez et al. | 439/422 |
| 5,581,879 | 12/1996 | Tsuji et al. | 29/861 |
| 5,661,250 | 8/1997 | Katahira et al. | 73/865.8 |
| 5,768,766 | 6/1998 | Hatagishi et al. | 29/753 |

*Primary Examiner*—Lee Young
*Assistant Examiner*—Kevin G. Vereene
*Attorney, Agent, or Firm*—Jordan B. Bierman; Bierman, Muserlian and Lucas

[57] ABSTRACT

An insulation displacement terminal of a high quality and high performance can be produced by designing the terminal in accordance with data measurement under a condition similar to an actual insulation displacement connection. An extent of insertion of an insulation sheath electric cable 6, a distance between a pair of metal blocks 11 and 12 spaced in parallel to each other, and a reaction force and a contact resistance acting between the cable 6 and the spaced metal blocks 11, 12 are measured, respectively, while inserting the cable 6 into a gap between the metal blocks 11 and 12 having a tapered portion on an end of each block. Then, an extent of insertion of the cable Δ2, a gap distance WS2, a reaction force F2, and a contact resistance R2 after completing the insertion are obtained and at the same time an occurrence of broken wires in the cable is judged. These steps are repeated while changing an initial gap WS between the metal blocks 11 and 12. A range in which the contact resistance R2 after completing the insertion becomes stable and the breakage of wires is not caused is set to be an allowable range out of a variable range of the gap WS2 between the spaced metal blocks after completing the insertion in accordance with the data and at the same time the corresponding reaction force and extent of insertion after completing the insertion are set.

4 Claims, 7 Drawing Sheets

A2; INITIAL WIDTH OF SLOT
B2; QUANTITY OF TERMINAL DISPLACEMENT
C2; SLOT WIDHT AFTER PRESS CONTACT

METHOD FOR PRODUCING AN INSULATION DISPLACEMENT TERMINAL AND THE SAME

BACKGROUND OF THE INVENTION

This invention relates to a method and an apparatus for producing an insulation displacement terminal which is designed to perform a given characteristic and to the insulation displacement terminal produced by the method.

For convenience of explanation, a conventional insulation displacement terminal and a method for producing the same will be described below by referring to FIGS. 11 to 14.

FIG. 11 is an explanatory view illustrating a method for producing a conventional insulation displacement terminal. FIG. 12 is a graph illustrating a relationship between a height of conductive wires and a compressive force in the case of producing the insulation displacement terminal by the method shown in FIG. 11. FIGS. 13A through 13C are explanatory views illustrating a change of arrangement of the conductive wires in association with compression in the case where the conductive wires of the insulation sheath cable comprise twisted wires. FIG. 14 is a front elevational view of a conventional insulation displacement terminal produced by the method shown in FIG. 11.

In general, an insulation displacement terminal 1 includes an insulation displacement blade 2 provided with a slot 3, as shown in FIG. 14. When an insulation sheath electrical cable 6 is inserted into the slot 3 from a distal end (upper end in FIG. 14) of the slot, conductive wires 7 (FIGS. 13A to 13C) come into press contact with the blade 2 while an insulation sheath 8 of the cable 6 (FIG. 11) is being cut by the blade 2, thereby completing an electrical connection between the cable 6 and the terminal 1. It has been required to set a characteristic of an insulation displacement in compliance with a kind of cable 6 being connected so as to obtain a good insulation displacement connection. FIG. 11 shows a conventional method for designing the insulation displacement terminal 1 which will satisfy such a requirement.

The method of designing the insulation displacement terminal 1 will be explained below.

First, the insulation sheath 8 of the electrical cable 6 is removed over a predetermined area to expose the conductive wires 7. Secondly, as shown in FIG. 11, a pair of probes 51 and 52 clamp the conductive wires 7 from which the insulation sheath 8 is removed. A compressive load and a height of the conductive wires are measured by changing a compressive load on the wires 7 exerted by the probe 52, as shown by an arrow. Then, in the case where the conductive wires 7 are made of a plurality of twisted wires (for example, seven twisted wires) a relationship between the compressive load and the height of the conductive wires is shown by lines 61*a* and 61*b* in FIG. 12. That is, when the twisted conductive wires 7 are subject to the compressive load, an arrangement of the wires 7 is changed, as shown in FIGS. 13A to 13C. The compressive load will alter irregularly to a point P in FIG. 12 during compression of the conductive wires 7 (a decrease of the height of the wires). When the conductive wires 7 are compressed over the point 7, however, the load rises abruptly (line 61*b*) since the twisted conductive wires 7 are compacted into a unit and behave as a single wire.

Accordingly, it is preferable to determine an initial slot width A1 of the insulation displacement terminal, a terminal displacement amount B1 after being brought into an insulation displacement at a predetermined press contact position, a slot width after being brought into the insulation displacement, and a reaction force corresponding to the terminal displacement amount B1 so that the insulation displacement will occur in an area within a point Q in FIG. 12 on which the load rises up abruptly. That is, a beam width, a thickness and a slot length of the insulation displacement terminal 1 are designed so that a curve line 62, which illustrates a relationship between a displacement and a reaction force which are caused by an elastical deformation from the initial slot width A1, will pass through the point Q.

However, since the electrical cable 6 is inserted into the slot 3 in the U-shapted insulation displacement terminal 1 shown in FIG. 14 from an upper part of the slot upon an actual insulation displacement, the electrical cable 6 also receives a force in an inserting direction. The conductive wires 7 cause arrangements different from those in the case where the wires are merely compressed from the upper part, as shown in FIG. 11. In addition, in actual insulation displacement, the insulation sheath 8 of the electrical cable 6 is cut by the slot at the initial stage of the insulation displacement, and thus this cutting condition is greatly different from the condition of predeterminately removing the insulation sheath over a given area in the manner shown in FIG. 11.

Accordingly, it is difficult in the manner shown in FIG. 11 to make an accurate estimate of an actual characteristic of connection. Assuming that an initial slot width, a terminal displacement amount, and a slot width after connection in an actual insulation displacement terminal are A2, B2 and C2, respectively, B2 and C2 are deviated from B1 and C1 shown in FIG. 12. Consequently, the actual terminal is inclined to be put on a condition different from designed values.

This inclination becomes more significant as a size of the conductive wires becomes smaller. This is a serious problem upon reducing a diameter of the electrical cable and compacting a portion of the insulation displacement in association with producing more compact devices.

SUMMARY OF THE INVENTION

A first object of the present invention is to provide a method for producing an insulation displacement terminal which can precisely realize an expected performance at a design time and provide a suitable insulation displacement connection by carrying out a design in accordance with data measured under conditions similar to an actual insulation displacement connection.

A second object of the present invention is to provide an apparatus for producing an insulation displacement terminal which can precisely realize an expected performance at a design time and provide a suitable insulation displacement connection by carrying out a design in accordance with data measured under conditions similar to an actual insulation displacement connection.

A third object of the present invention is to provide an insulation displacement terminal which can precisely realize an expected performance at a designing time and provide a suitable insulation displacement connection by carrying out a design in accordance with data measured under conditions similar to an actual insulation displacement connection.

In order to achieve the first object, a method for producing an insulation displacement terminal, in accordance with the present invention, which has an insulation displacement blade provided with a slot, in accordance with an insulation sheath electrical cable being worked, comprises the steps of: arranging a pair of metal blocks in parallel to each other so that the opposed side edges of the blocks can be resiliently spaced apart from each other, each metal block having a tapered portion at an end of the side edge; measuring an extent of insertion of the cable, a distance between the spaced metal blocks, a reaction force acting between the cable and the spaced metal blocks and a contact resistance acting between the cable and the spaced metal blocks while inserting the cable into a gap between the spaced metal blocks from the side of the tapered portions;

extracting data of an extent of the insertion, a spaced distance, a reaction force, and a contact resistance after completing the insertion out of data measured from the time when the insertion of the cable started to the time when the contact resistance is settled at the lowest level;

judging whether or not conductive wires of the cable are broken;

repeating the steps of the cable insertion, measurement, data extraction, and judgment of wire breakage while changing an initial gap between the spaced metal blocks; setting the range, in which the contact resistance after completing the insertion becomes stable and breakage of wires does not occur, to be an allowable range out of a variable range of the gap between the spaced metal blocks after completing the insertion in accordance with a relationship among the gap between the spaced metal block, reaction force, and contact resistance after completing the insertion in the case of changing the initial gap between the spaced metal blocks;

determining a design value of a gap between the spaced metal blocks after completing the insertion within the allowable range;

determining design values of a reaction force and an extent of insertion after completing the insertion in correspondence with the design value of a gap;

obtaining a displacement-reaction force characteristic in accordance with the design values, the characteristic being indicative of a reaction force corresponding to a design value of the reaction force after completing the insertion when the slot width is increased to the design value of the gap after completing the insertion at a position where a distance from a distal end of a slot in the terminal becomes the design value of the extent of the insertion after completing the insertion;

whereby the respective dimensions of the insulation displacement terminal are determined.

In order to achieve the second object, an apparatus for producing an insulation displacement terminal in accordance with the present invention is constructed as follows:

A pair of metal blocks are arranged in parallel to each other so that the opposed side edges of said blocks can be resiliently spaced apart from each other, each metal block has a tapered portion at an end of the side edge. A lower metal block of the pair of metal blocks is fixed on a table. An upper metal block of the pair of metal blocks is supported by a frame through a load cell for measuring a reaction force so that the block can be elastically displaced in an opening direction. The frame can be adjusted in a vertical direction and moved in the vertical direction by a driving means. The vertical adjustment of the frame can adjust an initial distance between the opposed metal blocks. The apparatus includes a displacement meter which measures an amount of displacement of the upper metal block to measure a distance between the opposed metal blocks, a means for measuring an extent of insertion of an electrical cable by detecting a position of the cable inserted in a gap between the metal blocks or by detecting an amount of displacement of an inserting jig for the cable into the gap between the metal blocks, and a circuit for measuring a contact resistance between the cable being worked and the metal blocks. The contact resistance measuring circuit interconnects the electrical cable and lower metal block through a potentiometer, and a constant current power source so that the contact resistance between the electrical cable and the lower metal block is measured in accordance with a voltage drop. Each of the measured values is supplied to a computing section, and the computing section carries out measurement of an extent of cable insertion, a distance between the spaced metal blocks, a reaction force, and a contact force during insertion of the electrical cable into the gap between the metal blocks in accordance with the signals from the respective measuring means.

In order to achieve the third object, an insulation displacement terminal in accordance with the present invention has an insulation displacement blade provided with a slot, in accordance with an insulation sheath electrical cable being worked and is produced by a method comprising the steps of:

using an apparatus in which a pair of metal blocks are arranged in parallel to each other so that the opposed side edges of the blocks can be resiliently spaced apart from each other, each metal block having a tapered portion at an end of the side edge;

measuring an extent of insertion of the cable, a distance between the spaced metal blocks, a reaction force acting between the cable and the spaced metal blocks and a contact resistance acting between the cable and the spaced metal blocks while inserting the cable into a gap between the spaced metal blocks from the side of the tapered portions;

obtaining data of an extent of the insertion, a spaced distance, a reaction force, and a contact resistance after completing the insertion of the cable which are measured at the time when the contact resistance is settled at the lowest level;

judging whether or not conductive wires of the cable are broken;

repeating the former steps while changing an initial gap between the spaced metal blocks;

setting the range, in which the contact resistance after completing the insertion becomes stable and the breakage of wires is not caused, to be an allowable range out of a variable range of the gap between the spaced metal blocks after completing the insertion in accordance with the above data; and in the case of setting a gap between the spaced metal blocks after completing the insertion, and a reaction force, and an extent of insertion after completing the insertion in correspondence with the gap within the allowable range to be design values, obtaining a displacement-reaction force characteristic in accordance with the design values, the characteristic being indicative of a reaction force corresponding to a design value of the reaction force after completing the insertion when the slot width is increased to the design value of the gap after completing the insertion at a position where a distance from a distal end of a slot in the terminal becomes the design value of the extent of the insertion after completing the insertion.

The insulation displacement terminal produced by the method and apparatus described above can take a behaviour of the electrical cable upon insertion into the slot and a state of breakage of the insulation sheath upon insertion of the cable similar to those of an actual insulation displacement of the terminal, since an extent of insertion, a distance between the spaced metal blocks, a reaction force, a contact resistance, and the like are measured in a design process while the electrical cable is being inserted into the gap between the pair of metal blocks from an end provided with the tapered portions. Thus, it is possible to precisely design the insulation displacement under an estimate of an actual insulation displacement.

In the producing method, in the step of determining a design value of a gap between the spaced metal blocks after completing the insertion a range including an allowable range is set to be within the allowable range, preferably.

Also, the producing method may further comprise the steps of:

determining an extent of insertion at the time when a distance between the spaced metal blocks becomes maximum during insertion of the cable, the maximum spaced distance, and the maximum reaction force upon the maximum spaced distance in accordance with the measurement which is carried out by inserting the electrical cable into a gap between the metal blocks, determining each design value of an extent of insertion upon the maximum spaced distance, the design value of insertion extent corresponding to the design value of the spaced distance after completing the insertion, the maximum spaced distance, and the maximum reaction force in accordance with the data obtained by repeating the measurement which is carried out by changing an initial spaced distance between the metal blocks, determining a reaction force corresponding to the design value of the maximum reaction force at the time when the slot width is widened to the design value of the maximum spaced distance at a position where a distance from the distal end of the slot in the insulation displacement terminal becomes the design value of insertion extent upon the maximum spaced distance. Thus, it is possible to carry out a design having a higher precision.

DETAILED DESCRIPTION OF THE PREFERRED EMBODIMENTS

Figure 1:
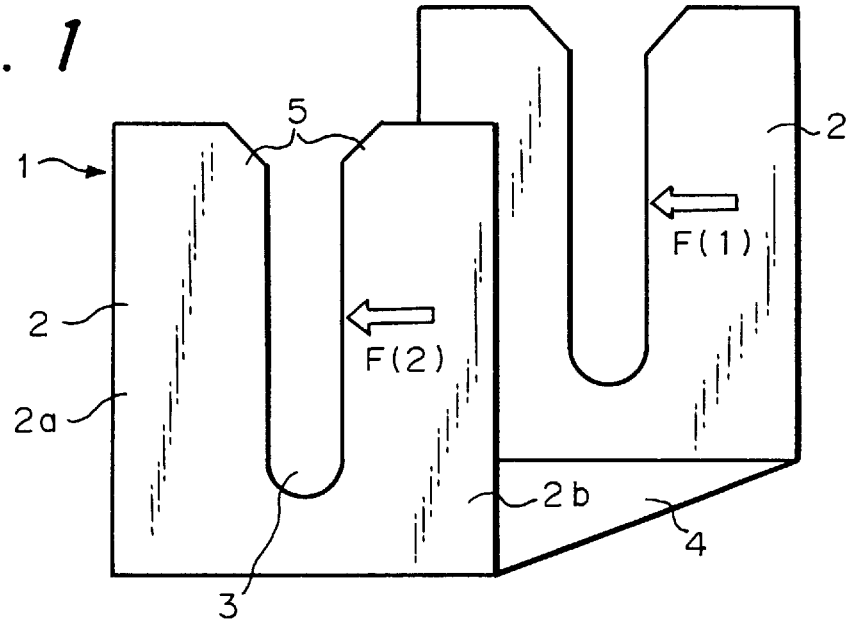
FIG. 1 is a perspective view of an example of an insulation displacement terminal produced by a method of the present invention.

Each embodiment of a method and an apparatus for producing an insulation displacement terminal and the same in accordance with the present invention will be described below by referring to the drawings.

FIG. 1 schematically illustrates an example of an insulation displacement terminal 1. The insulation displacement terminal 1 has at least one insulation displacement blade 2. The blade 2 includes a pair of beams 2*a* and 2*b* which are connected to each other at their proximal ends. A slot 3 is formed between the beams 2*a* and 2*b*. Each of the beams 2*a* and 2*b* is provided with a tapered portion 5 on an inner side at a distal end of the blade 2. In the illustrated embodiment, two insulation displacement blades 2 are connected to each other through a bottom plate 4 at a given distance in a front and rear direction. The blades 2 are integrally formed by punching a sheet of metal plate or the like.

Figure 2:
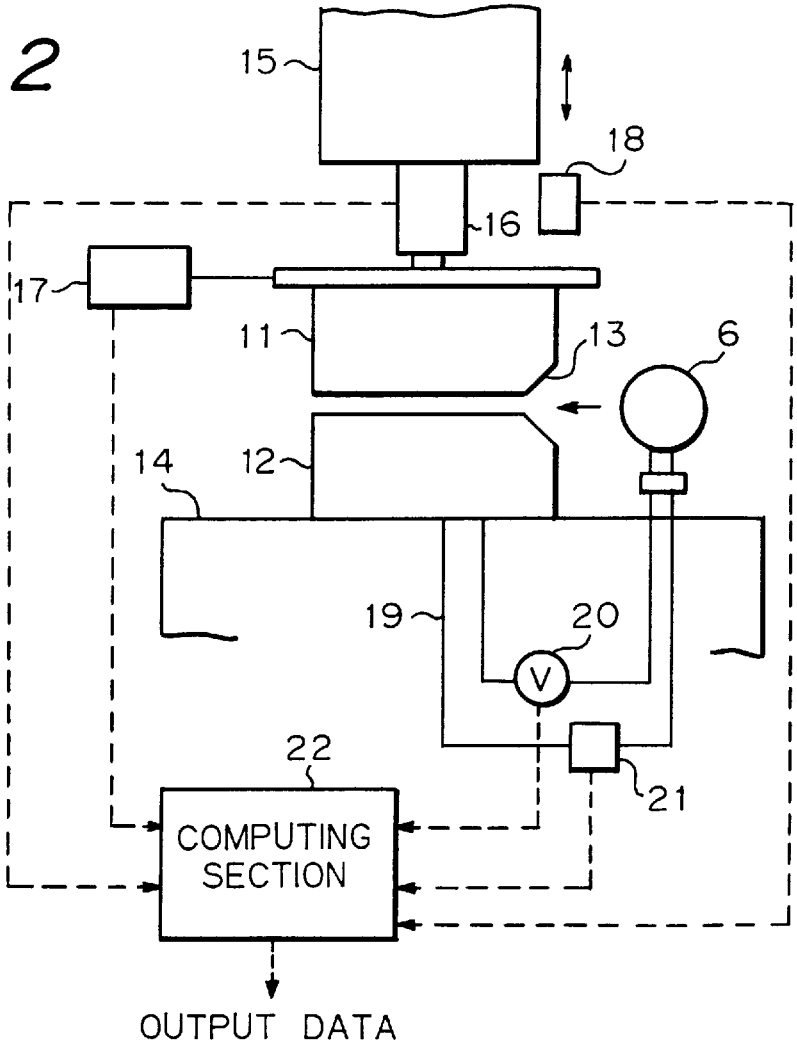
FIG. 2 is a schematic explanatory view of an apparatus which is used upon producing the insulation displacement terminal.

FIG. 2 shows an apparatus to be used in production of the insulation displacement terminal 1. The apparatus includes a pair of metal blocks 11 and 12 which are arranged in parallel to each other. The metal blocks 11 and 12 are provided on the ends of the opposed surfaces with the same tapered portions 13 as the tapered portions on the distal ends of the beams 2*a* and 2*b* of the insulation displacement blade 2, respectively.

The lower metal block 12 is fixed on a table 14. The upper metal block 11 is supported by a frame 15 through a load cell 16 for measuring a reaction force so that the block 11 can be elastically displaced in an opening direction (upward direction in FIG. 2). The frame 15 can be adjusted in a vertical direction and moved in the vertical direction by a driving means such as a motor or the like (not shown). The vertical adjustment of the frame 15 can adjust an initial distance between the opposed metal blocks 11 and 12.

The apparatus includes, as the respective measuring means, in addition to the load cell 16, a displacement meter 17 which measures an amount of displacement of the upper metal block 11 to measure a distance between the opposed metal blocks 11 and 12, a means for measuring an extent of insertion of an electrical cable by detecting a position of the cable inserted in a gap between the metal blocks 11 and 12 or by detecting an amount of displacement of an inserting jig for the cable (not shown) into the gap between the metal blocks 11 and 12, and a circuit 19 for measuring a contact resistance between the cable 6 being processed and the metal blocks 11, 12. The contact resistance measuring circuit 19 interconnects the electrical cable 6 and the metal block 12 through a potentiometer 20, a constant current power source 21, and the like so that the contact resistance between the electrical cable 6 and the metal block 12 is measured in accordance with a voltage drop or the like.

Each signal from the load cell 16, the displacement meter 17, the means 18 for measuring the extent of insertion, the contact resistance measuring circuit 19, and the potentiometer 20 is supplied to a computing section 22 including a computer and the like. The computing section 22 carries out measurement of an extent of cable insertion, a distance between the spaced metal blocks, a reaction force, and a contact resistance during insertion of the electrical cable 6 into the gap between the metal blocks 11 and 12 in accordance with the signals from the respective measuring means. Then, data described after can be obtained on the basis of the above measurement and indicated on a printer, a display, or the like.

A method of producing an insulation displacement terminal by utilizing the above apparatus will be explained below by referring to FIGS. 3 to 9.

Figure 3:
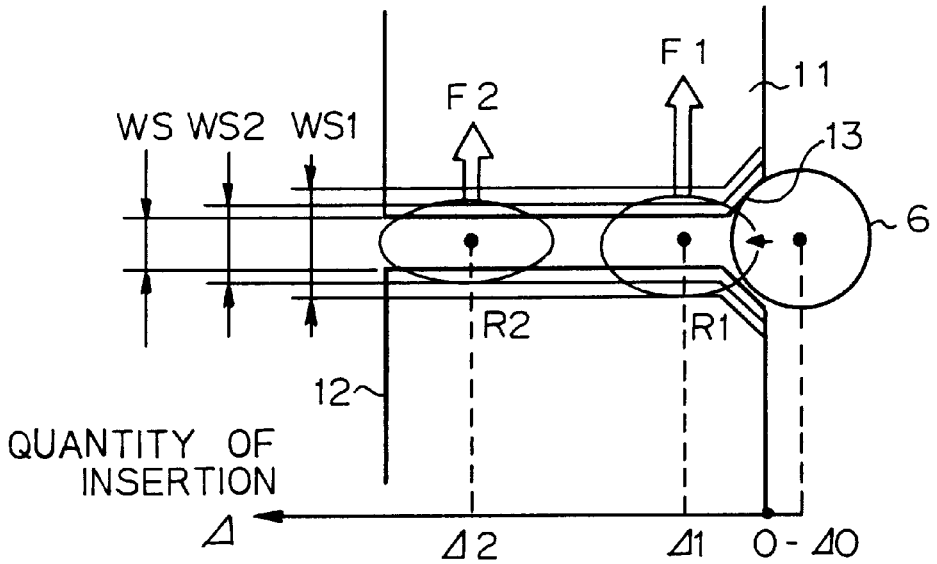
FIG. 3 is an explanatory view illustrating a process for inserting an insulation sheath electrical cable into a slot defined between a pair of metal blocks which correspond to the insulation displacement terminal.

First, as shown in FIG. 3, the pair of metal blocks 11 and 12 are spaced apart from each other by a predetermined initial slot width (initial spacing distance) WS to form a gap corresponding to the slot width of the insulation displacement terminal 1 between the metal blocks 11 and 12. At this time, the initial slot width WS is set to be smaller than a diameter of a core conductor (an assembly of conductive wires) of an electrical cable 6 being worked. Then, the cable 6 being worked is inserted into the gap or slot between the metal blocks 11 and 12 from the ends having the tapered portions 13. The metal blocks 11 and 12 are pushed in a vertical direction to widen the slot width (spacing distance between the metal blocks) as the electrical cable 6 is inserted therebetween. Consequently, a corresponding reaction force is exerted between the electrical cable 6 and the metal blocks 11, 12.

Figure 13A:
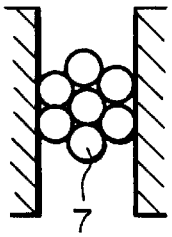
FIGS. 13A through 13C are explanatory views illustrating a change of arrangement of the conductive wires in association with compression in the case where the conductive wires of the insulation sheath cable comprise twisted wires.
Figure 13B:
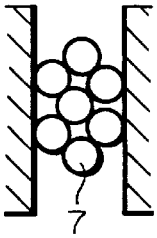
Figure 13C:
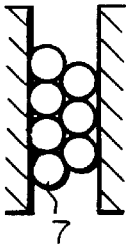
Figure 14:
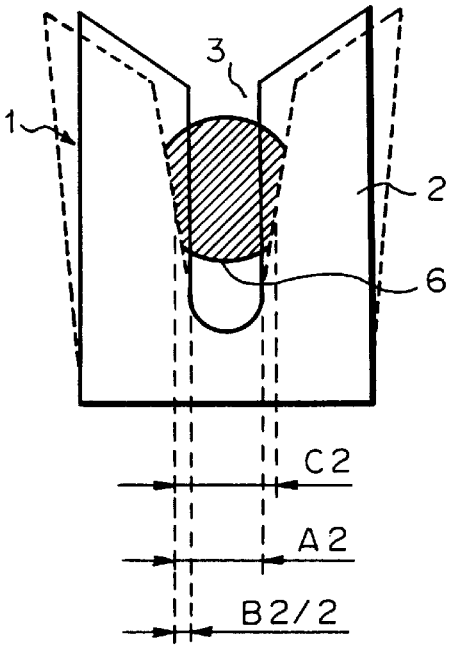
Fig. 14 PRIOR ART
FIG. 14 is a front elevational view of a conventional insulation displacement terminal produced by the method shown in FIG. 11.

An insulator sheath of the electrical cable 6 is broken by the metal blocks 11 and 12 upon insertion of the cable. If the core conductor of the electrical cable 6 comprises a plurality of conductive wires, an arrangement of the wires will be gradually brought into a flat shape through a change of arrangement of the wires (see FIG. 13) when the cable 6 passes through the tapered portions 13 of the metal blocks. In this case, a condition, in which the arrangement of the conductive wires is changed from a circular shape to a flat shape when the cable 6 is being inserted into the gap between the metal blades 11 and 12, is the same condition in which the cable 6 is inserted into the slot in an actual insulation displacement terminal.

Figure 4:
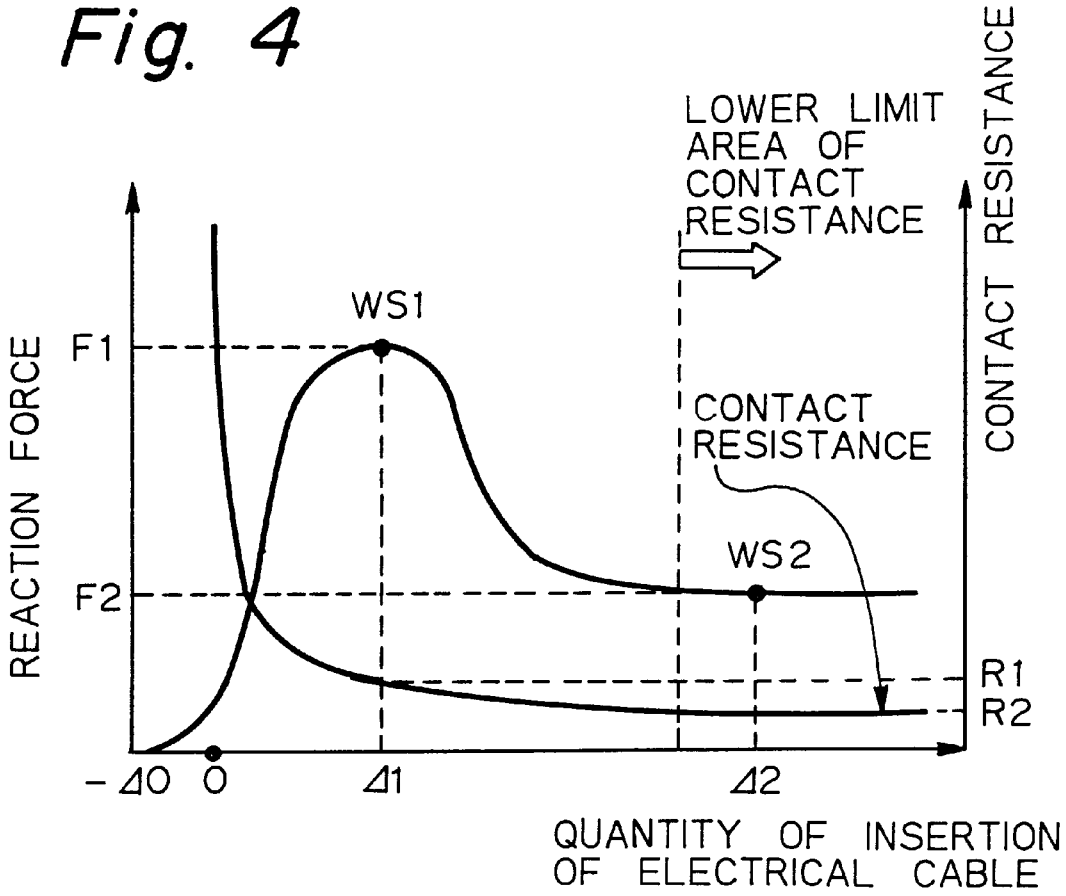
FIG. 4 is a graph illustrating a relationship among an inserting extent of the electrical cable, a reaction force, and a contact resistance.

Thus, data as shown in FIG. 4 can be obtained from measurement of each of extents of insertion of the electrical cable 6, slot widths (spaced distance between both metal blocks), and reaction forces and contact resistances between the cable and the metal blocks in the process of inserting the electrical cable 6 into the gap between the metal blocks.

That is, the reaction force is proportional to an increment of the slot which is widened upon insertion of the electrical cable 6 between the metal blocks 11 and 12. A slot width WS1 and a reaction force F1 become maximum at an extent of insertion Δ1 in which the cable 6 passes through the tapered portions 13. The slot width and reaction force become small gradually in association with flatening of the cable 6 upon further insertion of the cable 6 and a slot width WS2 and a reaction force F2 become stable over a certain extent of insertion. Also, the contact resistance becomes small gradually as the electrical cable 6 is inserted into the slot, and the contact resistance becomes stable over a certain extent of insertion. A range of the insertion extent in which the contact resistance is stable (hereinafter referred to a lower limit area of contact resistance) is substantially the same as a range in which the slot width and reaction force are stable.

Here, a slot width (maximum slot width) at an extent of insertion (extent of insertion Δ1 upon the maximum spaced distance) is indicated by WS1, and a reaction force (maximum reaction force) and a contact resistance under the same condition are shown by F1 and R1, respectively. An extent of insertion, a slot width, a reaction force, and a contact resistance under a condition in which the electrical cable 6 is inserted within the lower limit area of contact resistance are expressed as an extent of insertion after completing the insertion Δ2, a slot width after completing the insertion (spaced distance after completing the insertion) WS2, a reaction force after completing the insertion F2, and a contact resistance after completing the insertion R2, respectively. The extent of insertion after completing the insertion Δ2 is set to be a distal end side from a leading end of the lower limit area of contact resistance by more than half an allowance of an actual insertion extent.

Thus, the insertion and measurement of the electrical cable under a given initial slot width WS are carried out as shown in FIG. 3 and the respective data are obtained as shown in FIG. 4.

After completing these processes, the initial slot width WS is changed by adjusting a position of the frame in the apparatus shown in FIG. 2 and the similar processes are repeated. Thus, the processes described above are repeated while changing the initial slot width WS. The data shown in FIGS. 5 and 6 are obtained in accordance with the above manner.

Figure 5:
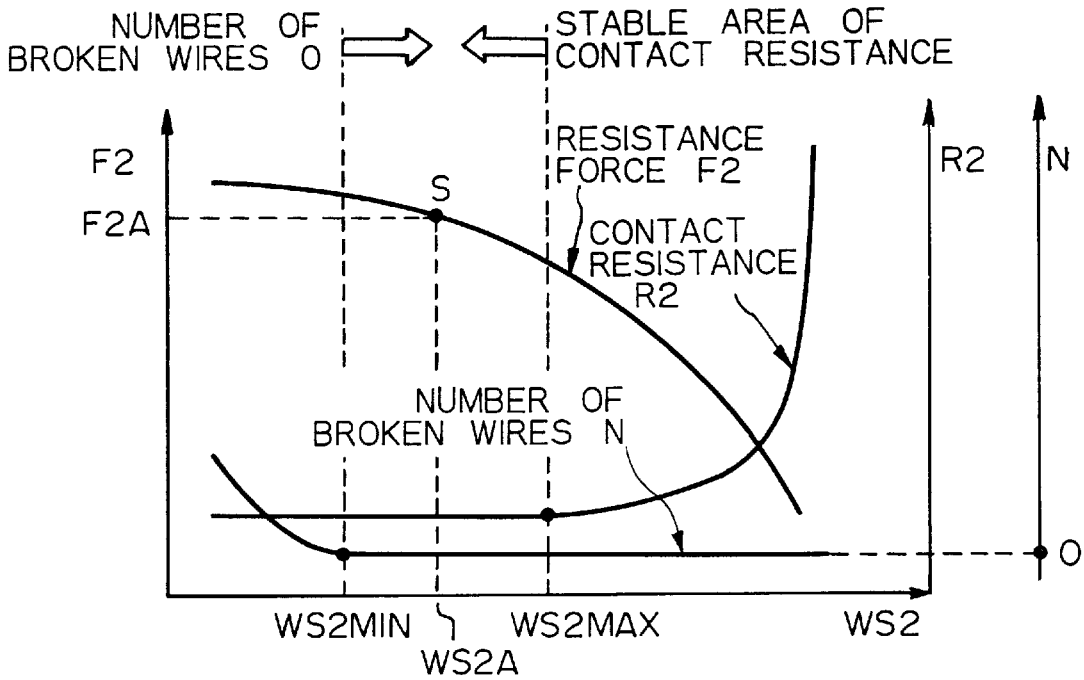
FIG. 5 is a graph illustrating relationship between a width of a slot and a reaction force after completing the insertion in the case where an initial width of a slot is changed, and between the contact resistance and the number of broken conductive wires after completing the insertion in the case where an initial width of a slot is changed, the axis of abscissa being indicative of the width of the slot after completing the insertion.
Figure 6:
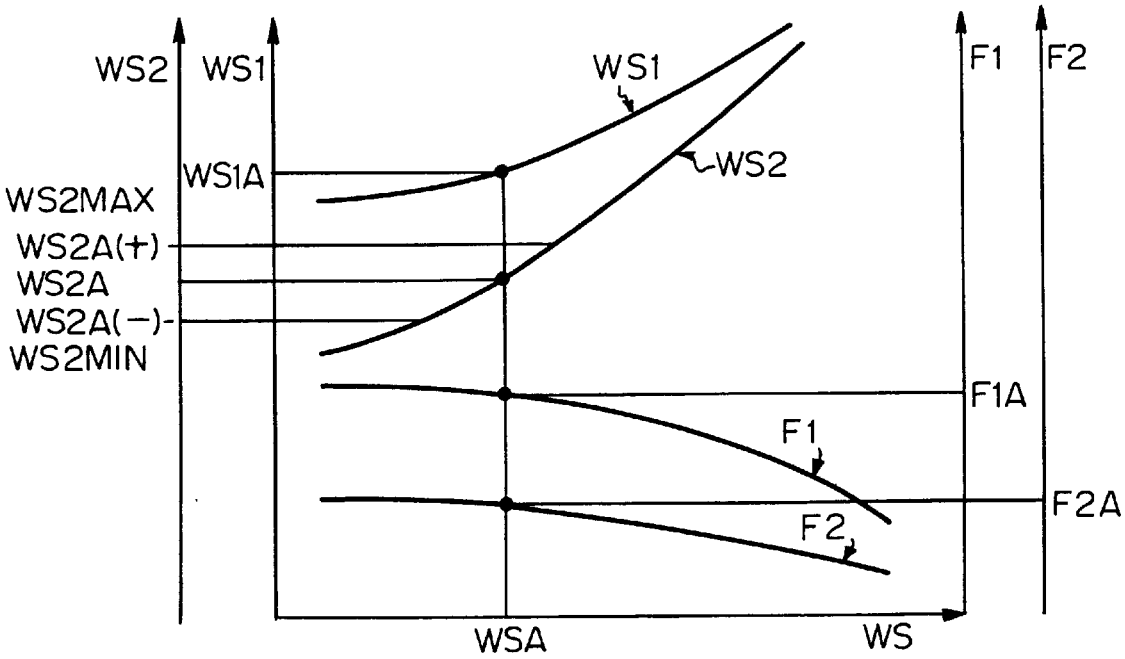
FIG. 6 is a graph illustrating a relationship among a maximum width of a slot, a maximum reaction force, a width of a slot after completing the insertion, and a reaction force after completing the insertion in the case where an initial width of a slot is changed, the axis of abscissa being indicative of the initial width of the slot.

FIG. 5 illustrates a relationship between the slot width WS2 after completing the insertion and the reaction force F2 after completing the insertion and a relationship between the contact resistance R2 after completing the insertion and the number N of breakage of the conductive wires, in the case of changing the initial slot width WS. In FIG. 5, the slot width WS2 after completing the insertion is indicated on an abscissa. Also, FIG. 6 shows a relationship between the respective maximum slot width WS1, maximum reaction force F1, slot width WS2 after completing the insertion, and reaction force F2 after completing the insertion and the initial slot width WS on the abscissa, in the case of varying the initial slot width WS.

It will be understood from FIG. 5 that the contact resistance R2 after completing the insertion is kept at constant within an area in which the slot width WS2 after completing the insertion is smaller than a certain value although the contact resistance R2 increases as the slot width WS2 after completing the insertion becomes large. If the range of the slot width WS2 after completing the insertion under a condition in which the contact resistance R2 after completing the insertion is maintained at constant is defined as "a contact resistance stable area", it is necessary to set design values described after to be within the contact resistance stable area to suppress a dispersion of the contact resistance due to errors upon production, a secular change, and the like of the insulation displacement terminal 1.

The breakage of the conductive wires occurs in the area where the slot width WS2 after completing the insertion is small and no breakage will occur when the slot width WS2 is larger than a certain value.

If a range in which the slot width WS2 after completing the insertion is set to be within the contact resistance stable area and no breakage of the conductive wires occurs is defined as "an allowable range", it is necessary to set a design value WS2A of the slot width WS2 after completing the insertion to be within the allowable range. That is, if the lower and upper limits of the allowable range are defined as WS2MIN and WS2MAX, respectively, it is necessary to make a relationship of WS2MIN<WS2A<WS2MAX. Preferably, as shown in FIG. 6, if a tolerance of the design values WS2A is a range from WS2A(+) to WS2A(−), it is necessary to determine the design value WS2A so that the range from WS2A(+) to WS2(−) is included in the allowable range. For example, it is preferable to set the design value to be an intermediate point in the allowable range between WS2MIN and WS2MAX.

After determining the design value WS2A of the slot width WS2 after completing the insertion, the values F2A, WS1A, F1A, and WSA corresponding to the design value WS2 with respect to the reaction force F2 after completing the insertion, the maximum slot width WS1, the maximum reaction force F1, and the initial slot width WS are given from the data shown in FIG. 6. Also, the extents of insertion Δ1A and Δ2A corresponding to the reaction forces F1A and F2A are given from the data (FIG. 7) which illustrate a relationship between the extent of insertion of the electrical cable and the reaction force at the time when the initial slot width is WSA.

In the case of designing the insulation displacement blade 2 of the insulation displacement terminal 1, the above values WS2A, F2A, and Δ2A are set to be the design values which give a displacement-reaction force characteristic of the insulation displacement blade at the insulation displacement position and the values WS1A, F1A, and Δ1A are set to be the design values which give a displacement-reaction force characteristic at the intermediate position of insertion of the electrical cable (at the position where the maximum reaction force occurs).

The reaction force is set to be F2A when the beams 2*a* and 2*b* are widened until the slot width becomes WS2A at the position of the distance Δ2A from the distal end of the slot 3 in the insulation displacement blade 2 to the electrical cable 6. Also, the reaction force is set to be F1A when the beams 2*a* and 2*b* are widened until the slot width becomes WS1A at the position of the distance Δ1A from the distal end of the slot 3 in the insulation displacement blade 2.

Figure 9:
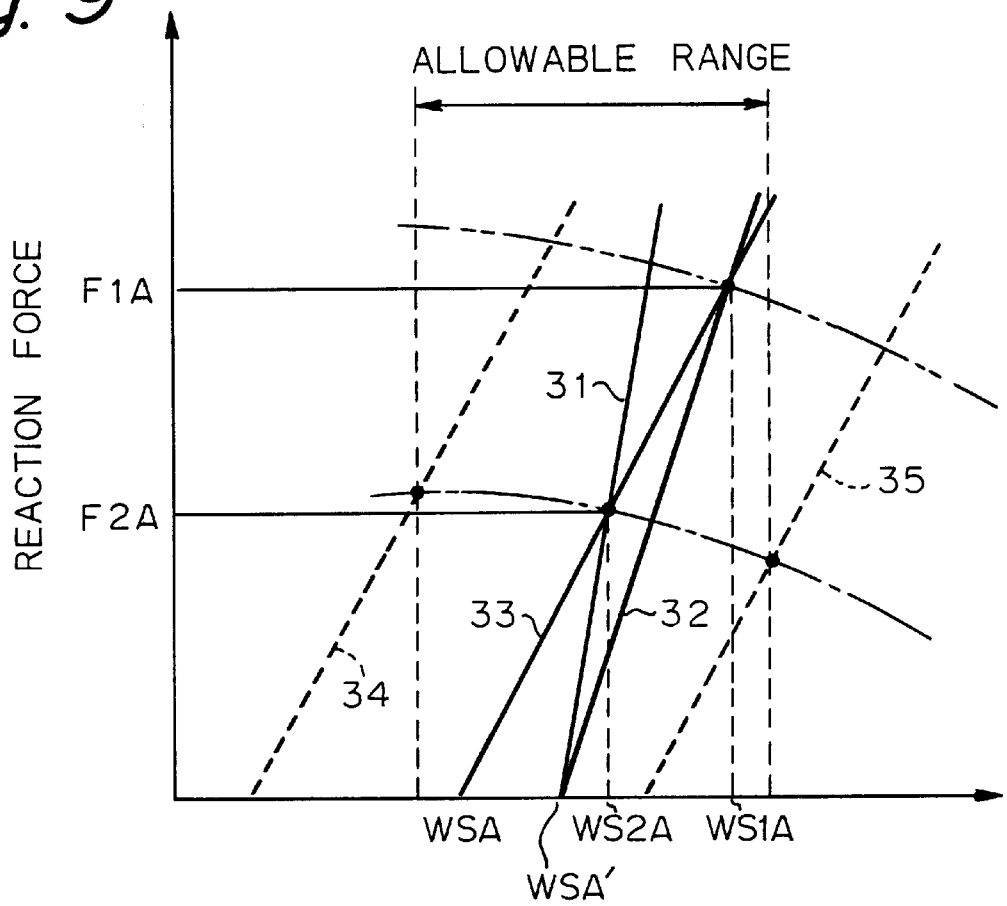
FIG. 9 is a graph illustrating a relationship between a width of a slot in an insulation displacement terminal and a reaction force.

In more particular, the initial slot width WSA', which is different from WSA, is set to be smaller than WS2A and to be a suitable value in consideration of limitation of the slot width due to a size of connector and a thickness of terminal. As shown in FIG. 9, a line 31, which illustrates a relationship between the displacement and the reaction force due to an elastic deformation of the beams from the initial slot width WSA', is set to pass the point (WS2A, F2A) at the position of the distance Δ2A from the distal end of the slot to the cable. Also, a line 32, which shows a relationship between the displacement and the reaction force due to the elastic deformation of the beams from the initial slot width WSA', is set to pass the point (WS1A, F1A) at the position of the distance Δ2A from the distal end of the slot to the cable. Thus, the beam width and thickness, the slot length, and the like of the insulation displacement terminal are designed to satisfy the above setting by means of analysis and experiment.

Lines 33, 34 and 35 in FIG. 9 are characteristic lines which illustrate a relationship between the displacement and the reaction force in the case of electing the initial slot width between the metal blocks 11 and 12 in the apparatus shown in FIGS. 2 and 3 as a variable.

According to the method described above, it is possible to carry out design and production of the electrical cable 6 having a stable contact resistance and a preferable insulation displacement characteristic and causing no breakage of the conductive wires under the insulation displacement condition in which the electrical cable 6 is inserted to a given insulation displacement position, by measuring the slot width, the reaction force, and the like while inserting the electrical cable 6 into the gap between the metal blocks 11 and 12 in the apparatus shown in FIGS. 2 and 3, and by determining the design values in accordance with the data obtained by repeating such measurement as the initial slot width between the metal blocks 11 and 12 is carried.

In particular, since the apparatus including the pair of metal blocks 11 and 12 provided with the tapered portion 13 on each end are utilized at a design stage to measure the slot width, the reaction force, and the like while inserting the electrical cable 6 into the slot between the metal blocks 11 and 12, it is possible to obtain the measured data of elements associated with the characteristics of the insulation displacement terminal under a condition similar to the actual condition of insulation displacement in which the actual insulation displacement terminal causes a change of arrangement of the conductive wires and a breakage of the insulator sheath of the electrical cable 6. Accordingly, the design of the insulation displacement terminal can be carried out suitably and accurately.

Figure 7:
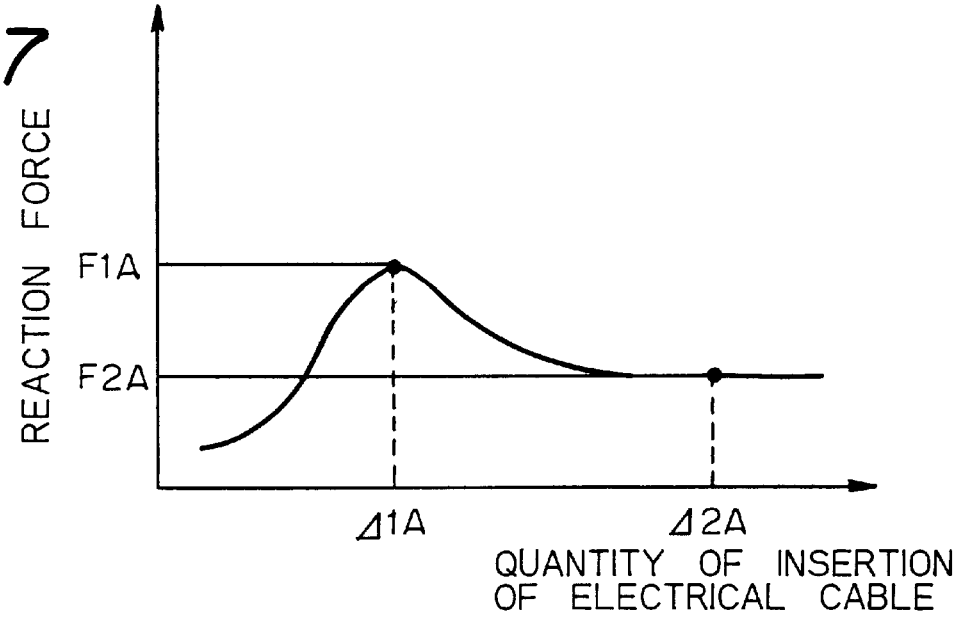
FIG. 7 is a graph illustrating a relationship between an extent of insertion of an insulation sheath cable and a reaction force in an initial width of a slot which corresponds to a designed value of a width of a slot after completing the insertion.
Figure 8:
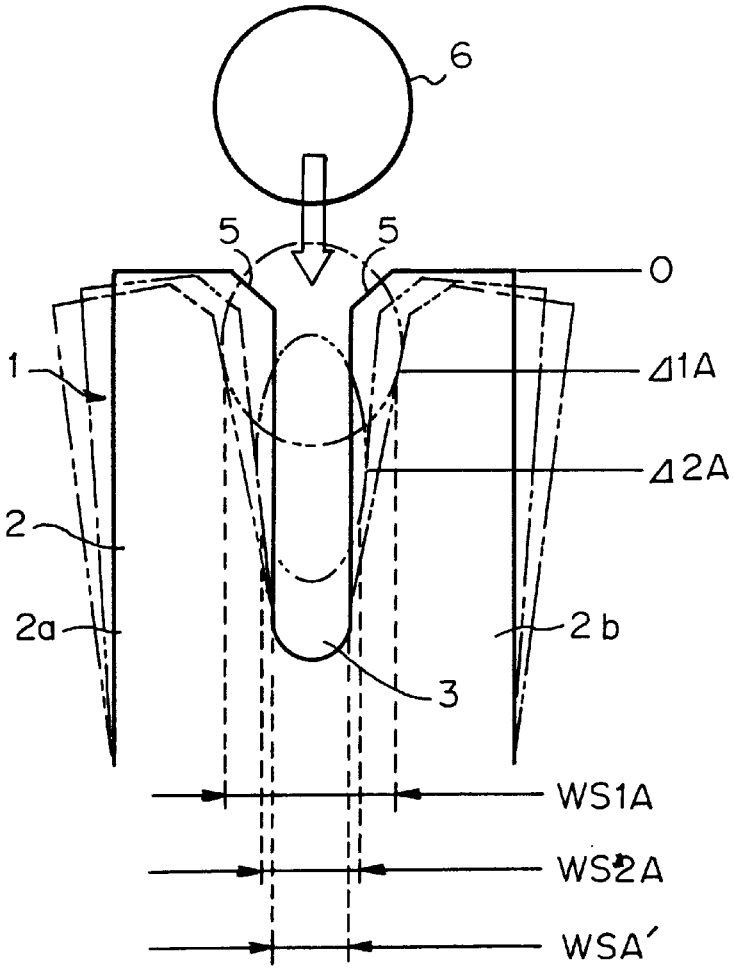
FIG. 8 is an explanatory view of an insulation displacement terminal which is produced in accordance with design values obtained by data from FIGS. 6 and 7.

In the above embodiment, Δ2A, WS2, F2A, Δ1A, WS1A and F1A are designed in accordance with the data shown in FIGS. 5 to 7. The characteristic value at a position of insulation displacement where the extent of insertion of the electrical cable becomes Δ2A satisfies the design values WS2A and F2A. The characteristic value at an intermediate position of insertion of the electrical cable where the extent of insertion becomes Δ1A satisfies the design values WS1A and F1A. However, at least Δ2A, WS2A and F2A should be set as the design values since Δ2A, WS2A and F2A are particularly important to a characteristic of insulation displacement Δ1A, WS1A and F1A are not necessarily used as the design characteristic at the intermediate position of insertion of the electrical cable. They may be within a certain range in which the breakage of the conductive wires in the electrical cable and/or the breakage of the terminal do not occur when the maximum reaction force is exerted during insertion of the electrical cable.

Figure 10:
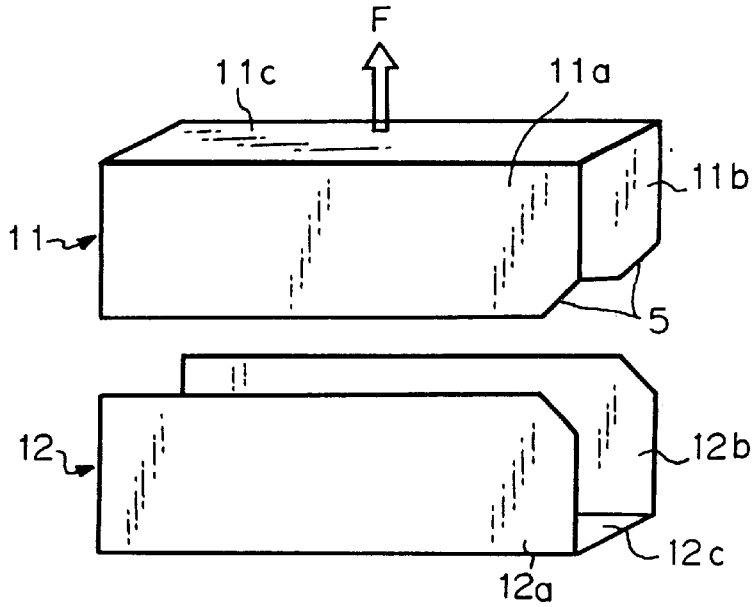
FIG. 10 is a perspective view of another member to be used upon producing the insulation displacement terminal.
Figure 11:
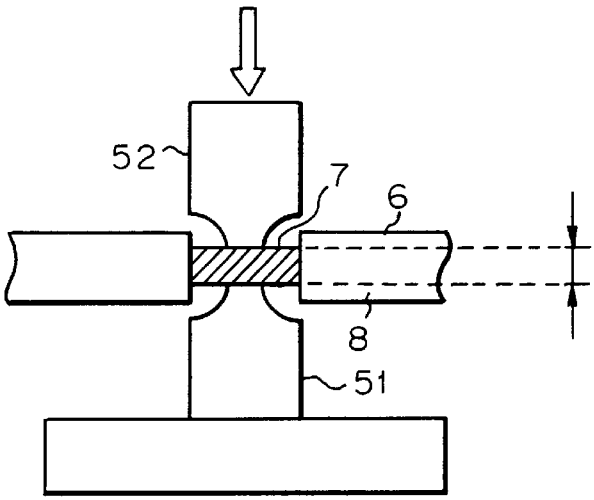
Fig. 11 PRIOR ART
FIG. 11 is an explanatory view illustrating a method for producing a conventional insulation displacement terminal.
Figure 12:
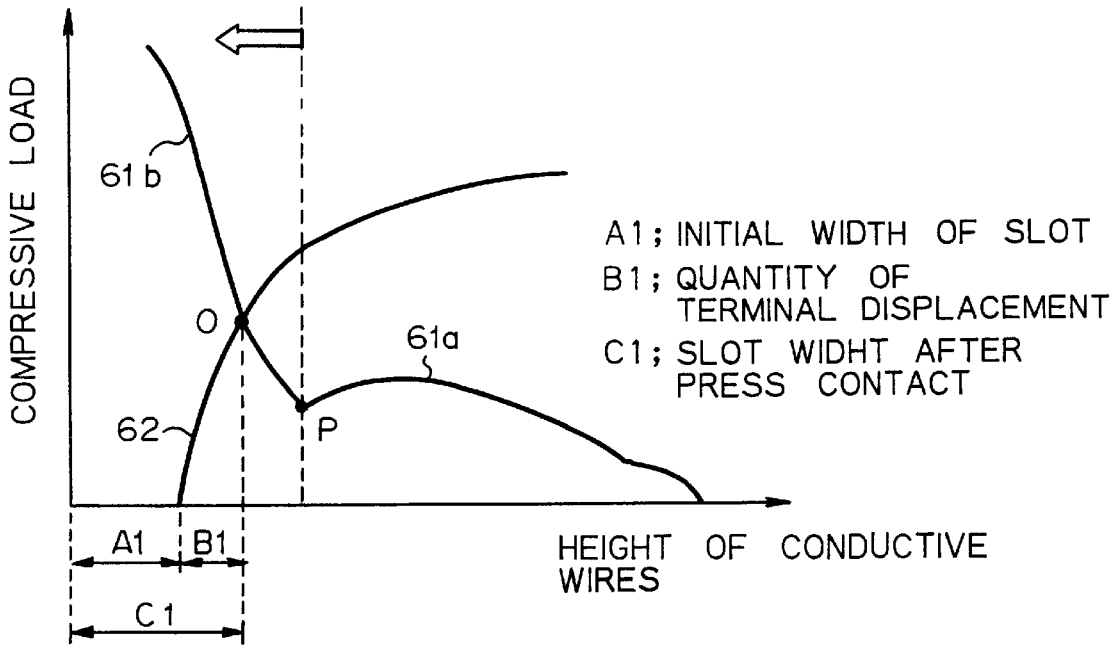
Fig. 12 PRIOR ART
FIG. 12 is a graph illustrating a relationship between a height of conductive wires and a compressive force in the case of producing the insulation displacement terminal by the method shown in FIG. 11.

In the case where the insulation displacement terminal 1 has two insulation displacement blades 2 spaced apart from each other by a given distance, each blade may be designed in the manner described above. However, as shown in FIG. 10, the pair of metal blocks 11 and 12 may be provided with two blade pieces 11*a*, 11*b* and 12*a*, 12*b* and connecting portions 11*c* and 12*c*, respectively. The blade pieces 11*a*, 11*b* and 12*a*, 12*b* are spaced apart from each other laterally and longitudinally by given distances in accordance with the actual insulation displacement terminal 1 having the insulation displacement blades 2. In the case, assuming that the two blade pieces 11*a* and 11*b* receive a reaction force F from the connecting portion 11*c* upon measuring and that each insulation blade 2 of the actual insulation displacement terminal 1 receives each of reaction forces F(1) and F(2) from the connecting portion 4, the design must be effected to satisfy the equation F=F(1)+F(2).

According to the present invention, upon producing of the insulation displacement terminal, a pair of metal blocks are arranged in parallel to each other, each metal block having a tapered portion at an end of the side edge. An extent of insertion of an insulation sheath electrical cable, a distance between the spaced metal blocks, reaction force acting between the cable and the spaced metal blocks, and a contact resistance acting between the cable and the blocks are measured while inserting the cable into a gap between the metal blocks from the side of the tapered portions. Thus, an extent of the insertion, a spaced distance, a reaction force, and a contact resistance after completing the insertion are obtained. Whether or not conductive wires in the cable are broken is judged. These steps are repeated while changing an initial gap between the spaced metal blocks. In accordance with these data, the range in which the contact resistance after completing the insertion becomes stable and the breakage of the wires is not caused is set to be an allowable range out of a variable range of the gap between the spaced metal blocks after completing the insertion. A design value of a gap between the spaced metal blocks after completing the insertion within the allowable range is determined. A displacement-reaction force characteristic is obtained from the data. Accordingly, it is possible to carry out the measurement upon design under a condition similar to the actual condition of insulation displacement and to estimate the actual condition of the insulation displacement. Thus, it is possible to produce an insulation displacement terminal having a high quality and estimated sufficiently upon design.

The entire disclosure of Japanese Patent Application No. 8-311538 filed on Nov. 22, 1996 including specification, claims, drawings and summary is incorporated herein by reference in its entirety.

What is claimed is:

1. A method for producing an insulation displacement terminal, which has an insulation displacement blade provided with a slot, in accordance with an insulation sheath electrical cable being worked, comprising:

arranging a pair of metal blocks in parallel to each other so that the opposed side edges of said blocks can be resiliently spaced apart from each other, each metal block having a tapered portion provided at an end of said side edge;

measuring an extent of insertion of said cable, a distance between said spaced metal blocks, a reaction force acting between said cable and said spaced metal blocks, and a contact resistance acting between said cable and said spaced metal blocks while inserting said cable into a gap between said spaced metal blocks from the side of said tapered portions;

extracting data on an extent of the insertion, a spaced distance, a reaction force, and a contact resistance after completing the insertion out of data measured from the time when the insertion of said cable started to the time when said contact resistance is settled at the lowest level;

judging whether or not conductive wires of said cable are broken;

repeating the cable insertion, measurement, data extraction, and judgment of wire breakage while changing an initial gap between said spaced metal blocks;

setting a range, in which the contact resistance after completing the insertion becomes stable and the breakage of wires is not caused, to be an allowable range out of a variable range of the gap between said spaced metal blocks after completing the insertion in accordance with a relationship among the gap between said spaced metal blocks, reaction force, and the contact resistance after completing the insertion in the case of changing the initial gap between said spaced metal blocks;

determining a design value of a gap between said spaced metal blocks after completing the insertion within said allowable range;

determining design values of a reaction force and an extent of insertion after completing the insertion in correspondence with said design value of the gap;

obtaining a displacement-reaction force characteristic in accordance with said design values, said characteristic being indicative of the reaction force corresponding to a design value of said reaction force after completing the insertion when the slot width is increased to the design value of the gap after completing the insertion at a position where a distance from a distal end of a slot in said terminal becomes the design value of the extent of the insertion after completing the insertion;

whereby the respective dimensions of said insulation displacement terminal are determined.

2. A method according to claim 1 wherein in determining a design value of the gap between said spaced metal blocks after completing the insertion, the range is set to be within an allowable range.

3. A method according to claim 1 further comprising:

determining an extent of the insertion at the time when a distance between said spaced metal blocks becomes maximum during the insertion of said cable, said maximum spaced distance, and a maximum reaction force upon said maximum spaced distance in accordance with the measurement which is carried out by inserting an electrical cable into the gap between said metal blocks, determining each said design value of an extent of the insertion upon the maximum spaced distance, said design value of the insertion extent corresponding to said design value of said spaced distance after completing the insertion, the maximum spaced distance, and the maximum reaction force in accordance with the data obtained by repeating the measurement which is carried out by changing an initial spaced distance between said metal blocks, determining the reaction force corresponding to the design value of said maximum reaction force at the time when said slot width is widened to the design value of said maximum spaced distance at a position where the distance from the distal end of said slot in said insulation displacement terminal becomes said design value of the insertion extent upon said maximum spaced distance.

4. The method of claim 1 comprising determining an extent of the insertion at the time when the distance between said spaced metal blocks becomes maximum during the insertion of said cable, said maximum spaced distance, and the maximum reaction force upon said maximum spaced distance in accordance with the measurement which is carried out by inserting the electrical cable into a gap between said metal blocks, determining each said design value of an extent of insertion upon the maximum spaced distance, said design value of the insertion extent corresponding to said design value of said spaced distance after completing the insertion, the maximum spaced distance, and the maximum reaction force in accordance with the data obtained by repeating the measurement which is carried out by changing the initial spaced distance between said metal blocks, determining the reaction force corresponding to the design value of said maximum reaction force at the time when said slot width is widened to the design value of said maximum spaced distance at the position where a distance from the distal end of said slot in said insulation displacement terminal becomes said design value of the insertion extent upon said maximum spaced distance.

* * * * *